US010337709B1

(12) United States Patent
Lo et al.

(10) Patent No.: US 10,337,709 B1
(45) Date of Patent: Jul. 2, 2019

(54) MIRRORING DEVICE

(71) Applicant: CAL-COMP BIG DATA, INC., New Taipei (TW)

(72) Inventors: Teng-Nan Lo, New Taipei (TW); Ming-Hua Hung, New Taipei (TW)

(73) Assignee: CAL-COMP BIG DATA, INC., New Taipei (TW)

( * ) Notice: Subject to any disclaimer, the term of this patent is extended or adjusted under 35 U.S.C. 154(b) by 0 days.

(21) Appl. No.: 16/138,970

(22) Filed: Sep. 22, 2018

(30) Foreign Application Priority Data

Aug. 1, 2018 (CN) ..... 2018 1 0863653

(51) Int. Cl.
*F21V 21/30* (2006.01)
*F21V 33/00* (2006.01)
*F21W 131/302* (2006.01)

(52) U.S. Cl.
CPC ..... *F21V 21/30* (2013.01); *F21V 33/004* (2013.01); *F21W 2131/302* (2013.01)

(58) Field of Classification Search
CPC ..... F21V 21/30; F21V 33/004
See application file for complete search history.

(56) References Cited

U.S. PATENT DOCUMENTS 6,273,585 B1 * 8/2001 Wu ..... F21V 21/30 362/135
2006/0152919 A1 * 7/2006 Pazula ..... F21V 21/02 362/135

* cited by examiner

*Primary Examiner* — Thomas M Sember
(74) *Attorney, Agent, or Firm* — Chun-Ming Shih; HDLS IPR Services

(57) ABSTRACT

A mirroring device having a housing, a mirroring assembly, an adjustable illuminator and an actuator is provided. The housing has a light transmissive cover. The mirroring assembly is disposed at the housing, the mirroring assembly has a display surface and the display surface exposes the outer housing, and the light transmissive cover surrounds the mirroring assembly. The adjustable illuminator is disposed in the housing corresponding to the light transmissive cover, the adjustable illuminator has a bracket, the bracket surrounds the mirroring assembly, at least one illumination component and at least one corresponding pivotal plate are arranged on the bracket, and the pivotal plate could pivot to change projecting direction of the illumination component. The actuator has a pusher connected to the pivotal plate for pushing the pivotal plate to pivot and thereby alter the projecting direction of the illumination component and focus position of the illumination component.

16 Claims, 14 Drawing Sheets

MIRRORING DEVICE

BACKGROUND OF THE INVENTION

Technical Field

The present disclosure relates to a mirroring device, in particular, to a mirroring device having projecting direction adjustable peripheral illumination.

Description of Related Art

In general, a user usually uses a mirror in dim environment such as dressing room or indoor. The user cannot clearly see the image on the mirror in the dim environment, when the user uses a smart mirror, a lens of the smart mirror cannot catch a clear image of wearing of the user for further processes. Some dressing mirrors are provided with forward projecting light source at its peripheral for additional illumination, but the light focus on a specific position in front of the mirror, the user cannot get sufficient light when the user leaves the position.

In views of this, in order to solve the above disadvantage, the present inventor studied related technology and provided a reasonable and effective solution in the present disclosure.

SUMMARY OF THE INVENTION

The present disclosure provides a mirroring device having projecting direction adjustable peripheral illumination.

According to the embodiment of the present disclosure, the mirroring device has a housing, a mirroring assembly, an adjustable illuminator and an actuator. The housing has a light transmissive cover. The mirroring assembly is arranged on the housing and has a display surface, the display surface is exposed on the housing, and the mirroring assembly is surrounded by the light transmissive cover. The adjustable illuminator is accommodated in the housing corresponding to the light transmissive cover, the adjustable illuminator has a bracket, the mirroring assembly is surrounded by the bracket, at least one illumination component and at least one pivotal plate corresponding to the illumination component are arranged on the bracket, the pivotal plate is rotatable for altering a projecting direction of the illumination component. The actuator has a pusher connected with the pivotal plate for pushing the pivotal plate to rotate.

According to the embodiment of the present disclosure, the actuator of the mirroring device has an operating member, a slope is formed on one of the operating member and the pusher, the other of the operating member and the pusher is pressed by the slope, the pivotal plate is pushed to rotate by the operating member when the operating member is moved according to the pusher. The slope is formed on the operating member, the pusher is pivotally connected to the pivotal plate and the slope is pressed by the pusher. The light transmissive cover is of a circular ring-shaped and thereby able to rotate around the bracket and be the operating member, the slope is arranged on an internal surface of the light transmissive cover, the slope is rotated by the light transmissive cover to push the pusher when the light transmissive cover is rotated and the pivotal plate is further rotated thereby. Operating member is a screw rod arranged in the housing and rotatable, the slope is formed on teeth of the screw rod, the slope is rotated by the screw rod to push the pusher when the screw rod is rotated, and the pivotal plate is further rotated thereby. The slope is formed on the pusher, the operating member is arranged in the housing and movable, and the slope is pressed by the operating member. The pivotal plate is connected with an elastic member for pushing the pivotal plate to rotate and the pusher is thereby pushed toward the operating member. The slope is disposed oblique related to the display surface.

According to the embodiment of the present disclosure, the adjustable illuminator of the mirroring device could have multiple pivotal plates, the pivotal plates are arranged surrounding the mirroring assembly, and each pivotal plate is hooked with another adjacent pivotal plate, the respective pivotal plates hooked with each other are rotatable and interlocked with each other. A couple of flanges are respectively protruded from opposite edges of each pivotal plate, and the respective flanges are hooked with another adjacent pivotal plate. The respective flanges of each pivotal plate are arranged deviated from each other and respectively toward two surfaces of the pivotal plate, and each flange is stacked and hooked with another flange on another adjacent pivotal plate.

According to the embodiment of the present disclosure, the actuator of the mirroring device could have the pusher connected with the pivotal plate and penetrating the housing. Alternatively, a pivot shaft could be extended from the pivotal plate and the pivot shaft is pivotally connected to the bracket, and the pusher is extended along the pivot shaft from the pivotal plate and penetrates the housing. Alternatively, the pivotal plate could be pivotally connected with the housing by a pivot shaft, and the pusher is extended along the pivot shaft from the pivotal plate and penetrates the housing.

According to the embodiment of the present disclosure, the mirroring assembly of the mirroring device could have a reflector, the reflector is surrounded by the light transmissive cover, the display surface for reflect and display a mirror image is formed on the reflector. Alternatively, the mirroring assembly could have a lens and a display panel, the display panel is electrically connected to the lens, the display panel is surrounded by the light transmissive cover, the display surface is formed on the display panel for displaying an imaged caught by the lens, and the lens and the display surface are arranged toward the same direction.

According to the embodiment of the present disclosure, the mirroring device has an adjustable illuminator, the adjustable illuminator is rotated by a pivotal plate to alter a projecting direction of the illumination component and a focus position of the illumination component could be thereby altered.

BRIEF DESCRIPTION OF DRAWING

The present disclosure can be more fully understood by reading the following detailed description of the embodiment, with reference made to the accompanying drawings as follows.

DETAILED DESCRIPTION OF THE INVENTION

Figure 1:
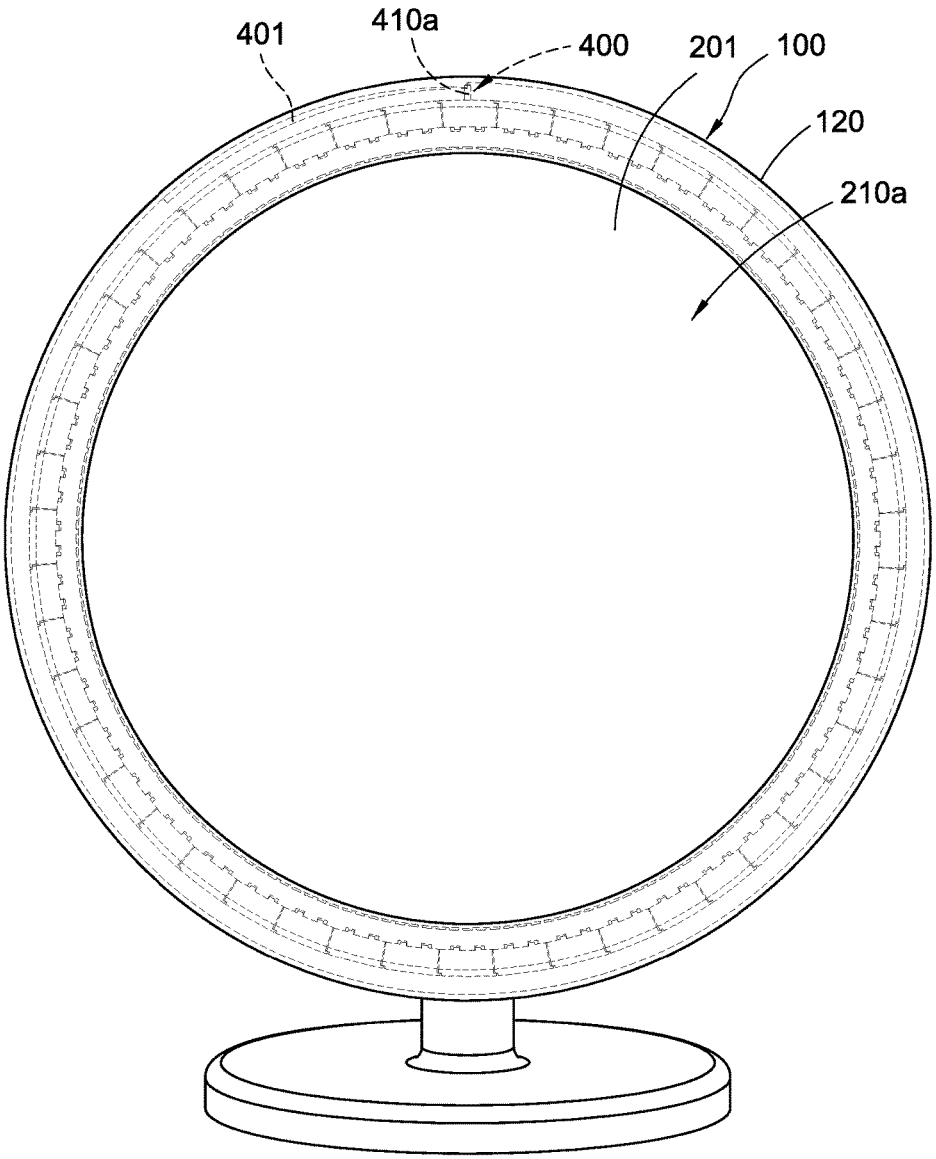
FIG. 1 is a perspective view showing the mirroring device of a first embodiment of the present disclosure.
Figure 2:
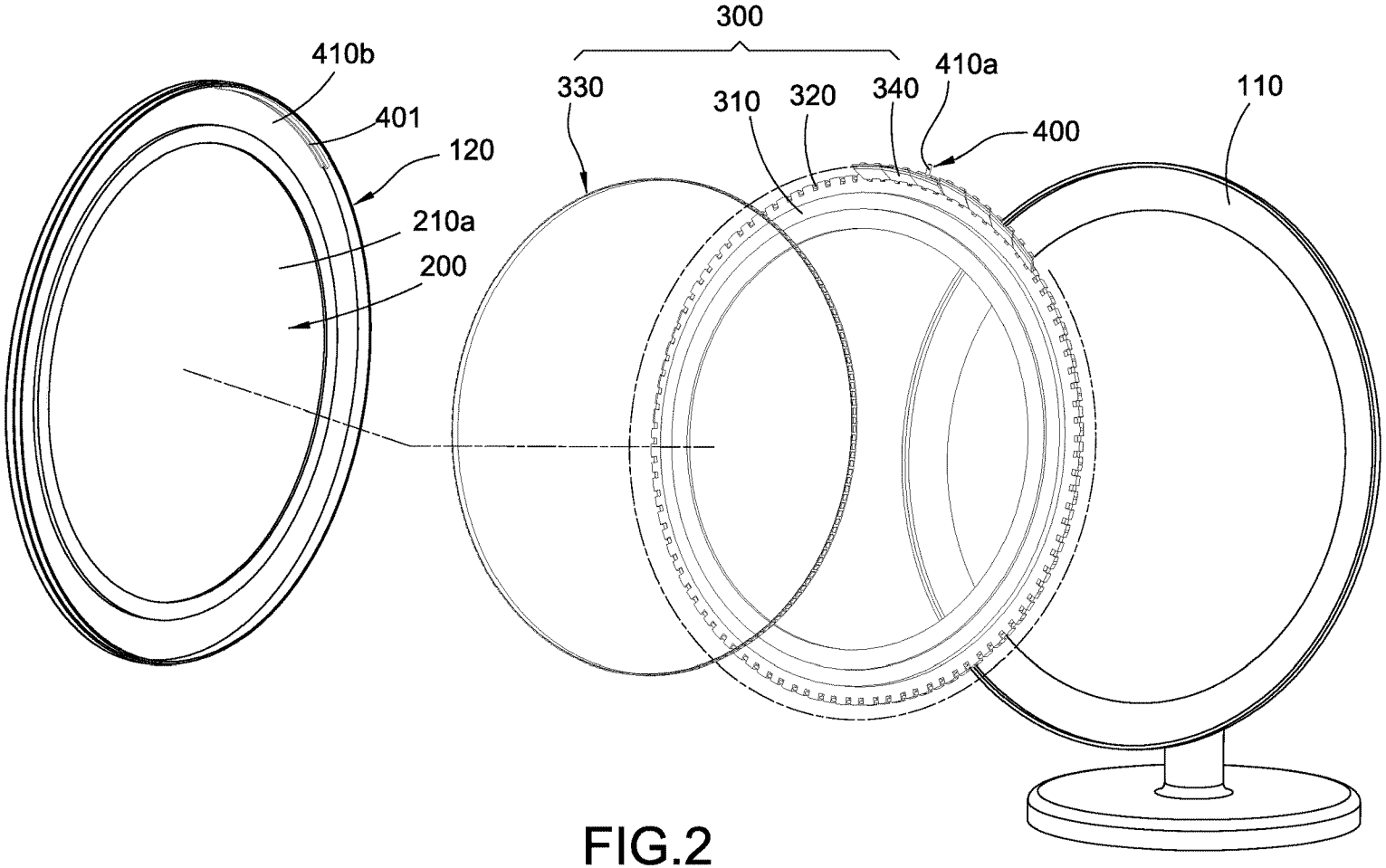
FIG. 2 is an exploded view showing the mirroring device of the first embodiment of the present disclosure.
Figure 3:
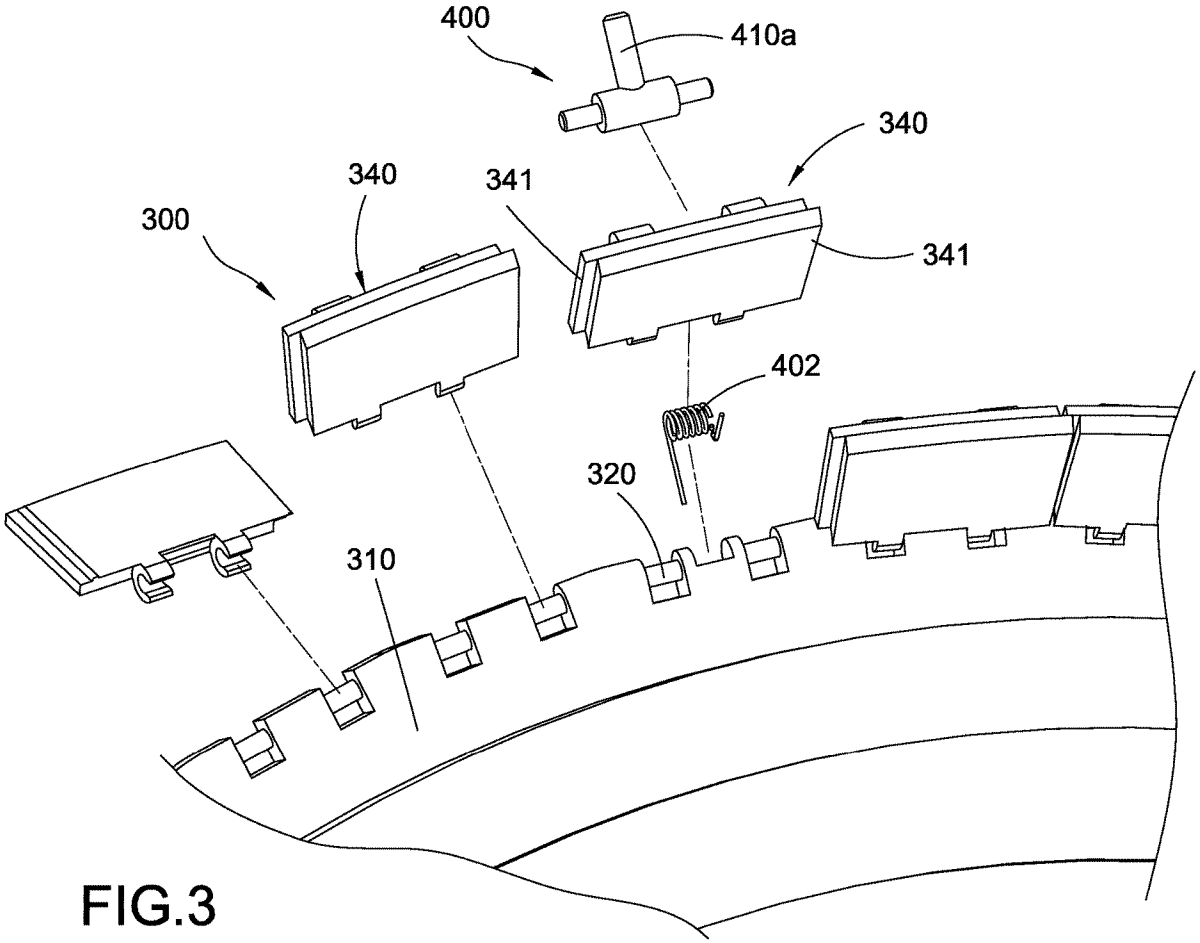
FIG. 3 is an exploded view showing the adjustable illuminator and the actuator of the mirroring device of the first embodiment of the present disclosure.
Figure 4:
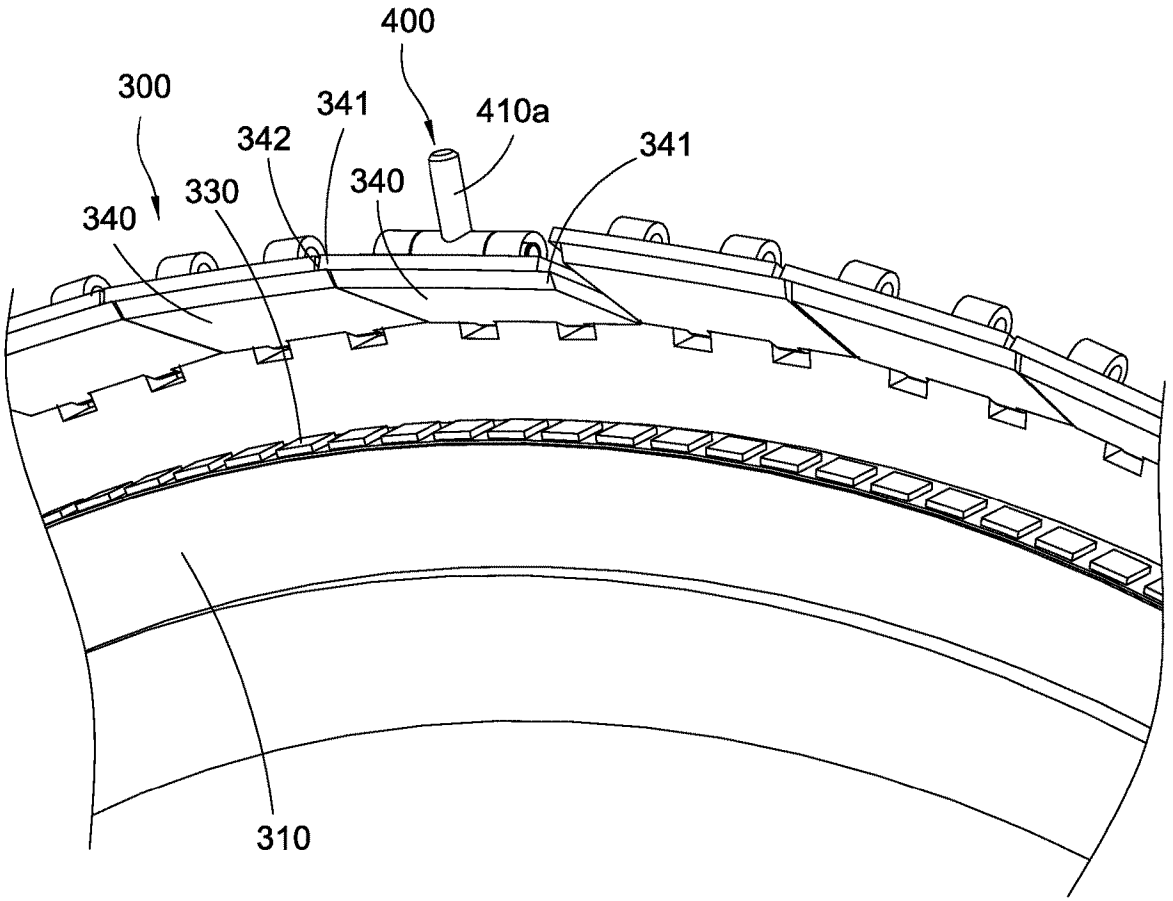
FIG. 4 is a perspective view showing the adjustable illuminator and the actuator of the mirroring device of the first embodiment of the present disclosure.
Figure 5:
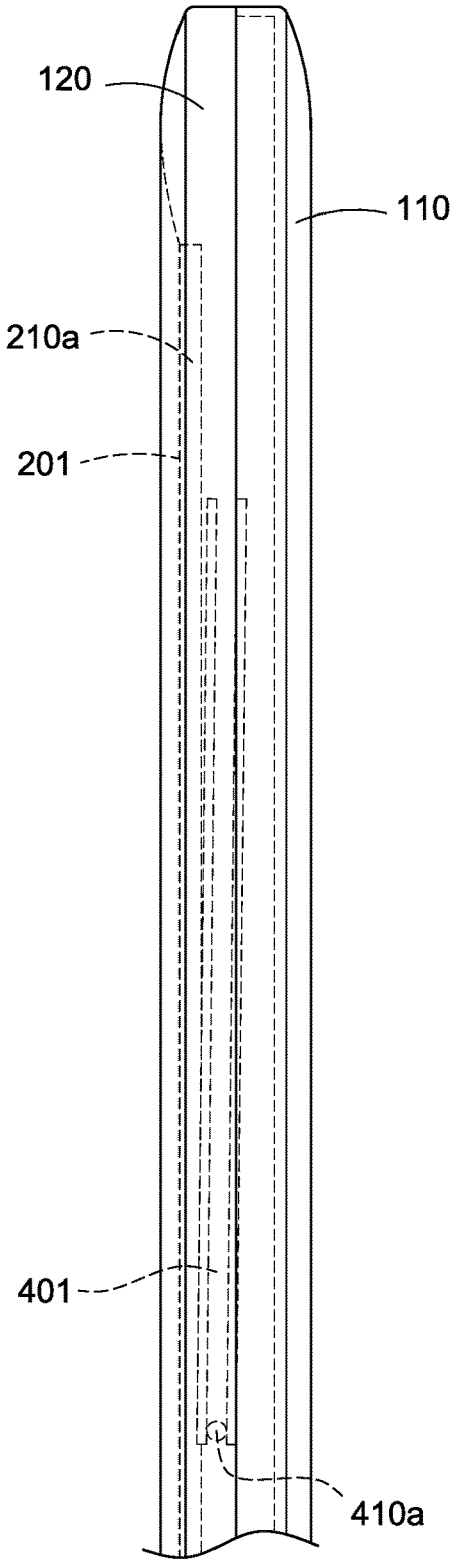
FIG. 5 is a perspective view showing the arrangement of the light transmissive cover and the actuator of the mirroring device of the first embodiment of the present disclosure.
Figure 6:
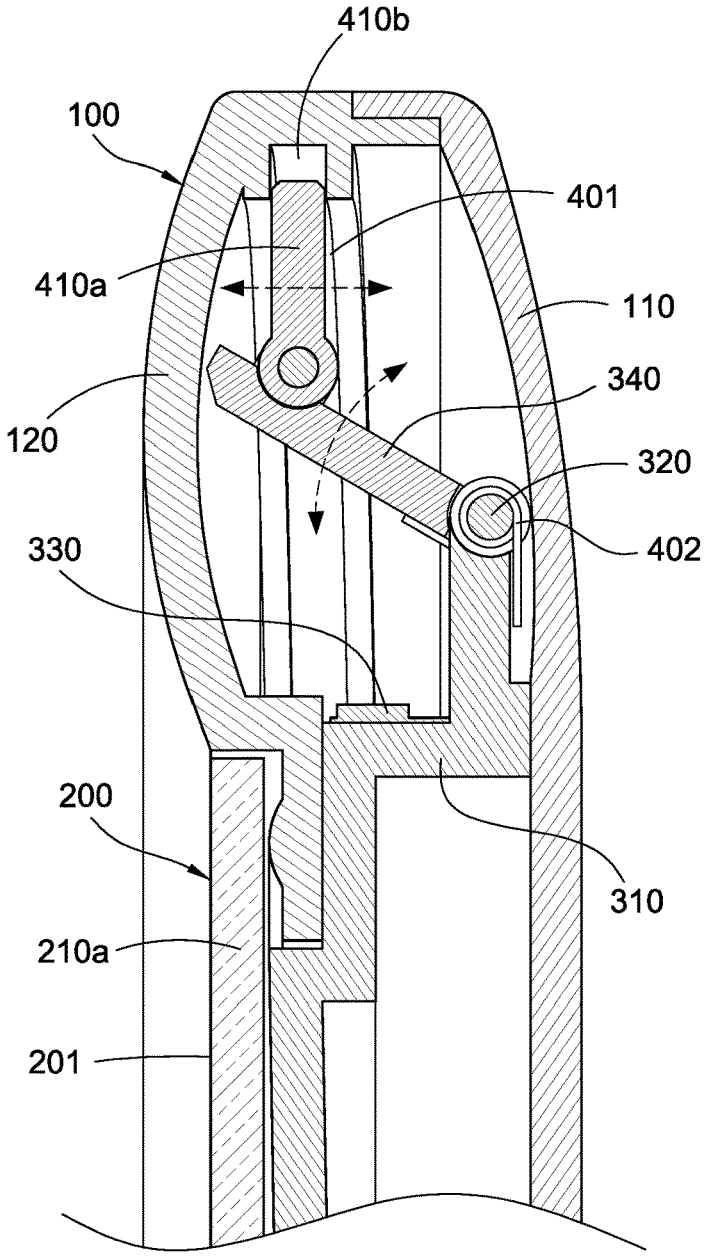
FIG. 6 is a schematic view showing an operation status of the mirroring device of the first embodiment of the present disclosure.

According to FIGS. 1-6, a mirroring device having a housing 100, a mirroring assembly 200, an adjustable illuminator 300 and an actuator 400 is provided in the first embodiment of the present disclosure.

The housing 100 has a back cover 110 and a light transmissive cover 120 opposite covering to each other. The back cover 110 is preferably circular-shaped, and the light transmissive cover 120 is preferably ring-shaped and preferably circular ring-shaped according to the present embodiment.

The mirroring assembly 200 is arranged on the housing 100, and a display surface 201 is defined on the mirroring assembly 200. The mirroring assembly 200 is surrounded by the light transmissive cover 120 and the display surface 201 is thereby exposed on the housing 100 through the light transmissive cover 120. According to the present embodiment, the mirroring assembly 200 could have a reflector 210*a*. The reflector 210*a* is surrounded by the light transmissive cover 120, and the display surface 201 is defined on the reflector 210*a* for reflecting and displaying an image of a user in front of the mirroring device on the display surface 201.

The adjustable illuminator 300 is accommodated in the housing 100 corresponding to position of the light transmissive cover 120. The adjustable illuminator 300 has a bracket 310, and the mirroring assembly 200 is surrounded by the bracket 310. The bracket 310 is preferably circular ring-shaped according to the present embodiment, and the light transmissive cover 120 is preferably circular ring-shaped and thereby being able to rotate around the bracket 310. At least one pivot shaft 320 parallel with a tangential direction of a peripheral edge of the bracket 310 is arranged on the peripheral edge of the bracket 310, according to the present embodiment, multiple pivot shafts 320 are preferably arranged on the peripheral edge of the bracket 310 and the bracket 310 is surrounded by the pivot shafts 320. At least one illumination component 330 and at least one pivotal plate 340 corresponding to the illumination component 330 are arranged on the bracket 310, according to the present embodiment, and multiple illumination components 330 and multiple pivotal plates 340 corresponding to the illumination components 330 are preferably arranged on the bracket 310. Moreover, the number of the pivotal plates 340 is preferably the same as the number of the pivot shafts 320, a side edge of each pivotal plate 340 is pivotally connected with corresponding pivot shaft 320. The pivotal plate 340 is rotatable and projecting directions of the illumination components 330 are thereby altered. According to the present embodiment, the projecting directions of the illumination components 330 are disposed divergently along the display surface 201. The respective pivotal plates 340 could be pivoted to be inclined related to the display surface 201 and an angle is formed therebetween, and lights projected from the illumination component 330 are thereby reflected toward an area in front of the display surface 201. A distance between the display surface 201 and a focus position of the reflected light projected from the illumination component 330 is altered according to change of the angle caused by pivoting of the pivotal plate 340.

The actuator 400 is linked with the pivotal plate 340 and thereby being able to rotate the pivotal plate 340. According to the present embodiment, the actuator 400 preferably has a pusher 410*a* connected with the pivotal plate 340 and for pushing the pivotal plate 340, and an operating member 410*b* connected with the pusher 410*a* and allowed to be operated by a user. A slope 401 is formed on one of the operating member 410*b* and the pusher 410*a* and the other of the operating member 410*b* and the pusher 410*a* is pressed by the slope 401. The pivotal plate 340 could be moved by the operating member 410*b* to pivot the pivotal plate 340 when the operating member 410*b* is moved related to the pusher 410*a*.

Specifically, according to the present embodiment, the pusher 410*a* is a level, an end of the pusher 410*a* is pivotally connected with the pivotal plate 340 and rotatable related to the pivotal plate 340, and the pivotal plate 340 thereby could be pivoted. The light transmissive cover 120 is rotatable and meanwhile could be used as the operating member 410*b*. A slope 401 is arranged on an internal surface of the light transmissive cover 120, and the slope 401 is oblique related to the display surface 201. The other end of the pusher 410*a* presses on the slope 401. The slope 401 is rotated related to the pusher 410*a* when the light transmissive cover 120 is rotated, and the pusher 410*a* is thereby pushed by the slope 401 to further pivot the pivotal plate 340. The pusher 410*a* is rotated and pushed by the slope 401 to move forward or backward related to the display surface 201, and the pivotal plate 340 is thereby further pivoted.

The pivotal plate 340 arranged a pusher 410*a* thereon is connected with an elastic member 402 for pivoting the pivotal plate 340 and thereby pushing the pusher 410*a* toward and to press on the operating member 410*b*. According to the present embodiment, the elastic member 402 is preferably a cylinder spring sleeved on the pivot shaft 320 of the pivotal plate 340, and two ends of the elastic member 402 respectively press on the bracket 310 and pivotal plate 340 to pivot the pivotal plate 340. Each pivotal plate 340 is hooked with another adjacent pivotal plate 340 so that the pivotal plates 340 are hooked together, and thereby rotatable and interlocked with each other. Specifically, a couple of flanges 341 are respectively protruded from opposite edges of each pivotal plate 340, and the respective flanges 341 of each pivotal plate 340 are arranged deviated from each other and respectively toward two surfaces of the pivotal plate 340, and each flange 341 is stacked and hooked with another flange 341 on another adjacent pivotal plate 340. Preferably, a gap 342 is formed between the edges of adjacent pivotal plates 340. Thereby, the pivotal plates 340 are allowed to be converged when rotated forward related to the display surface 201.

Figure 7:
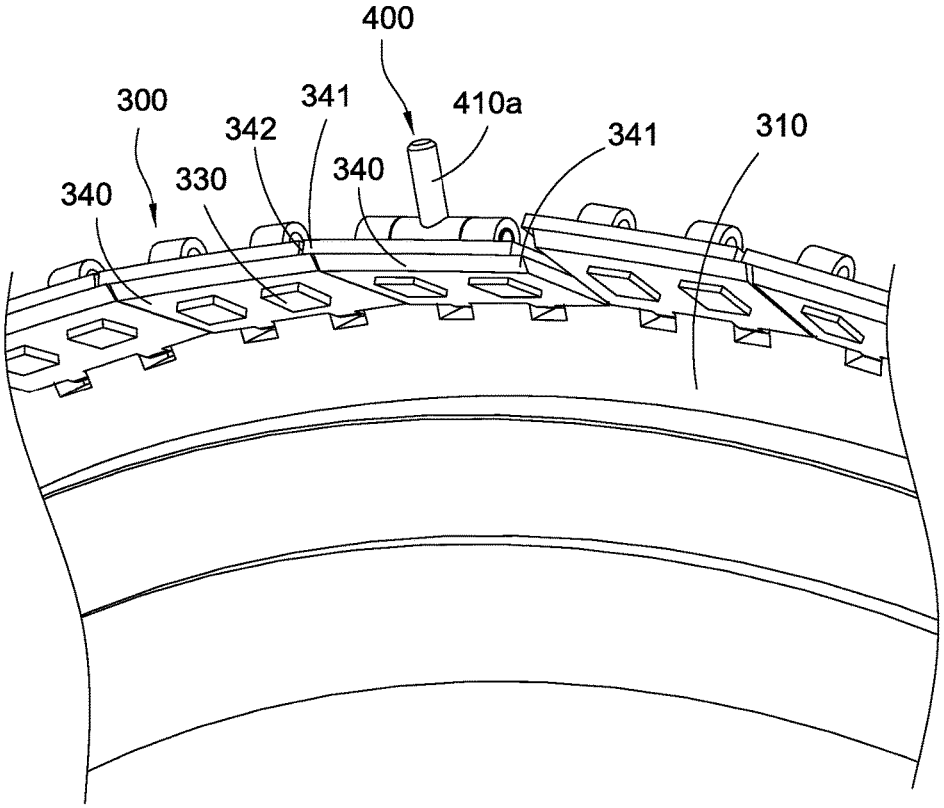
FIGS. 7 and 8 are schematic views showing various modes of the mirroring device of the first embodiment of the present disclosure.

According to another alternative arrangement of the adjustable illuminator 300 of the present embodiment shown in FIG. 7, at least one illumination component 330 is arranged on each pivotal plate 340 of the adjustable illuminator 300. According to the present embodiment, multiple illumination components 330 are preferably arranged on each pivotal plate 340. The illumination components 330 are arranged on a surface of the pivotal plate 340 and at a side edge of the pivotal plate 340 where the display surface 201 is located, respective projecting directions of the respective illumination components 330 are perpendicular to the pivotal plate 340. Each pivotal plate 340 could be rotated to be oblique related to the display surface 201 and an angle is formed therebetween, and lights projected from the respective illumination components 330 thereby focus on an area with a specific distance in front of the display surface 201. A distance between the display surface 201 and a focus position of the reflected light projected from the illumination component 330 is altered according to change of the angle caused by pivoting of the pivotal plate 340.

Figure 8:
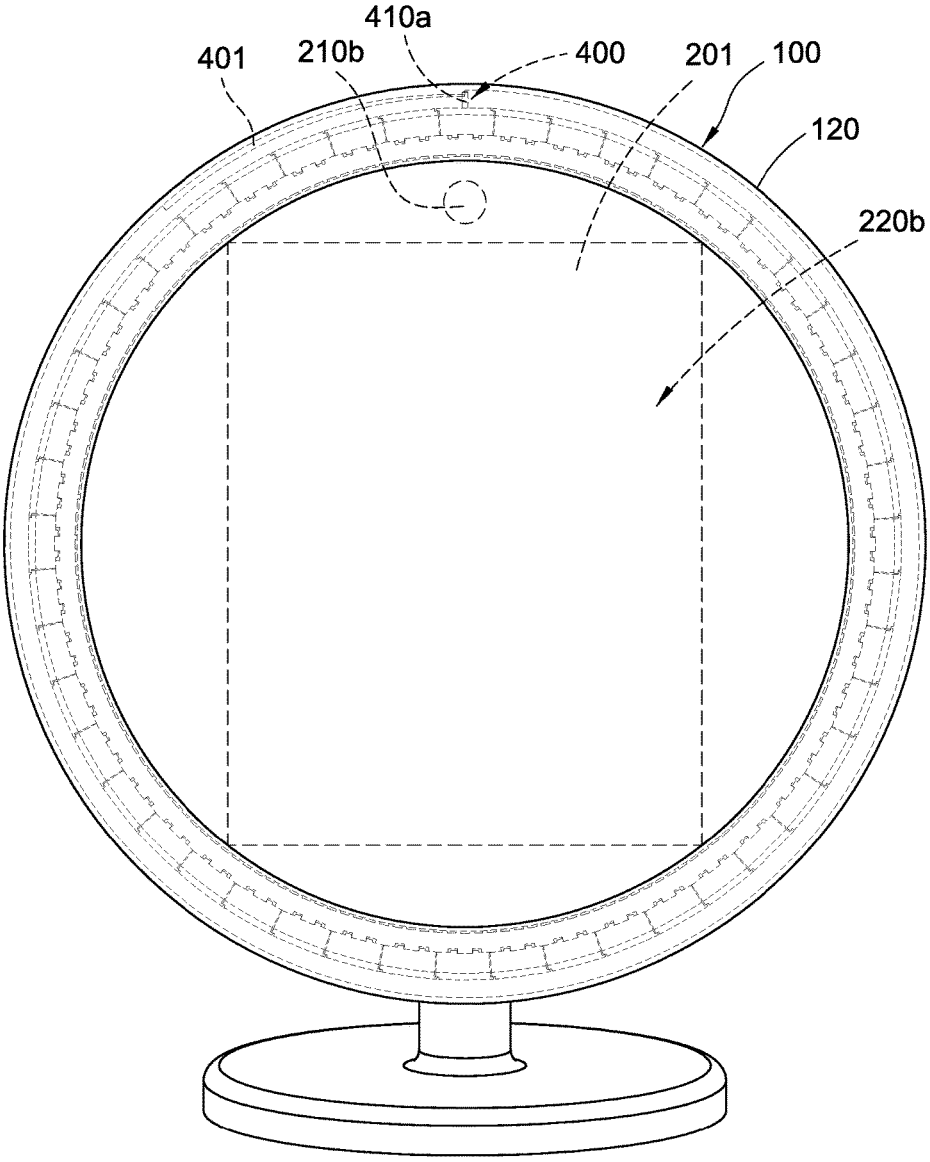

According to another alternative mode of the mirroring assembly 200 of the present embodiment shown in FIG. 8, the mirroring assembly 200 could include a lens 210*b* and a display panel 220*b*. The display panel 220*b* is electrically connected to the lens 210*b*, the display panel 220*b* is surrounded by the light transmissive cover 120, the display surface 201 is formed on the display panel 220*b* for displaying an image caught by the lens 210*b*, and the lens 210*b* and the display surface 201 are arranged toward the same direction. The lens 210*b* catches the image of the user in front of the mirroring device and the image is displayed on the display surface 201 of the display panel 220*b*.

Figure 9:
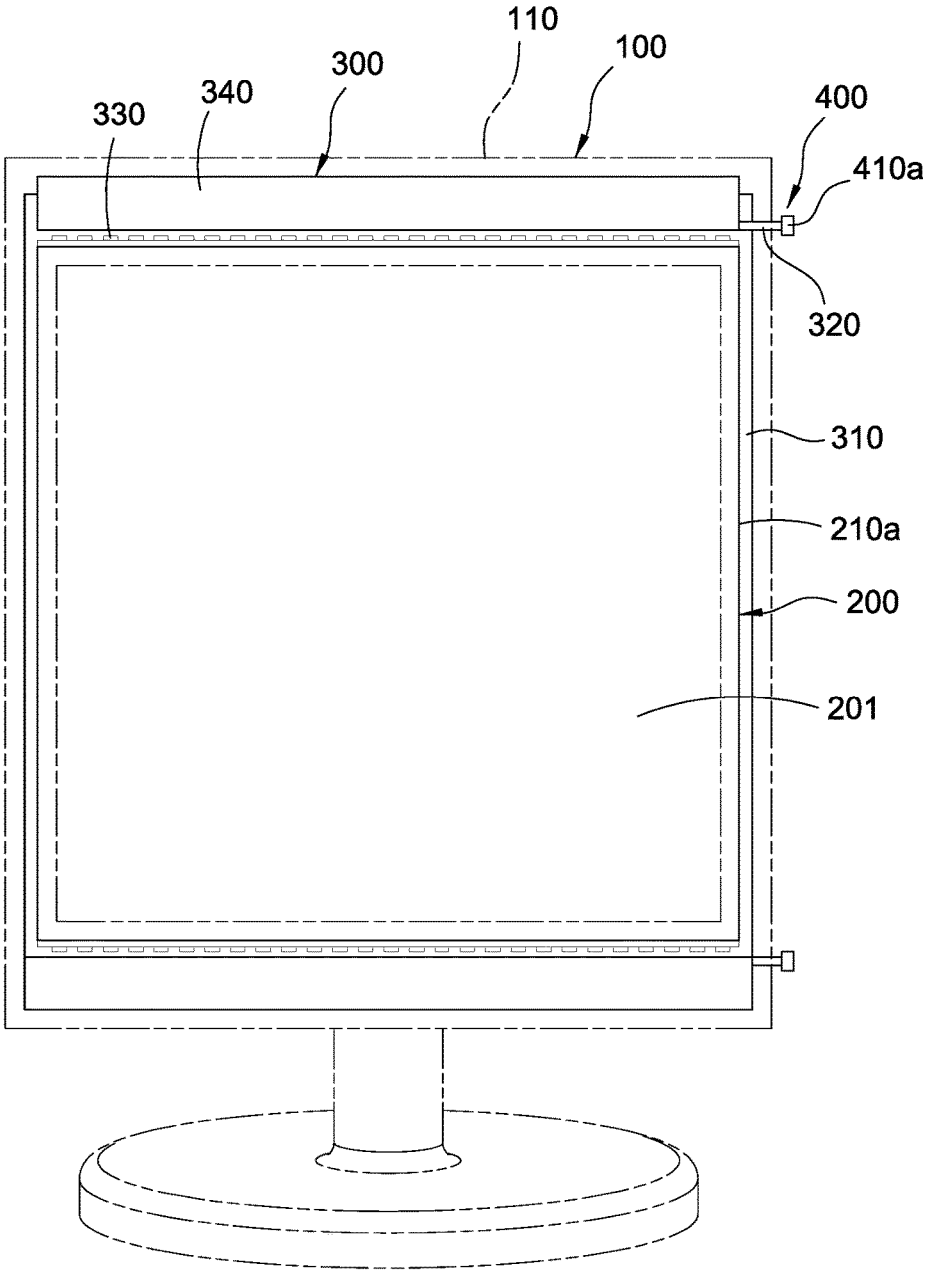
FIG. 9 is a schematic view showing the mirroring device of the second embodiment of the present disclosure.
Figure 10:
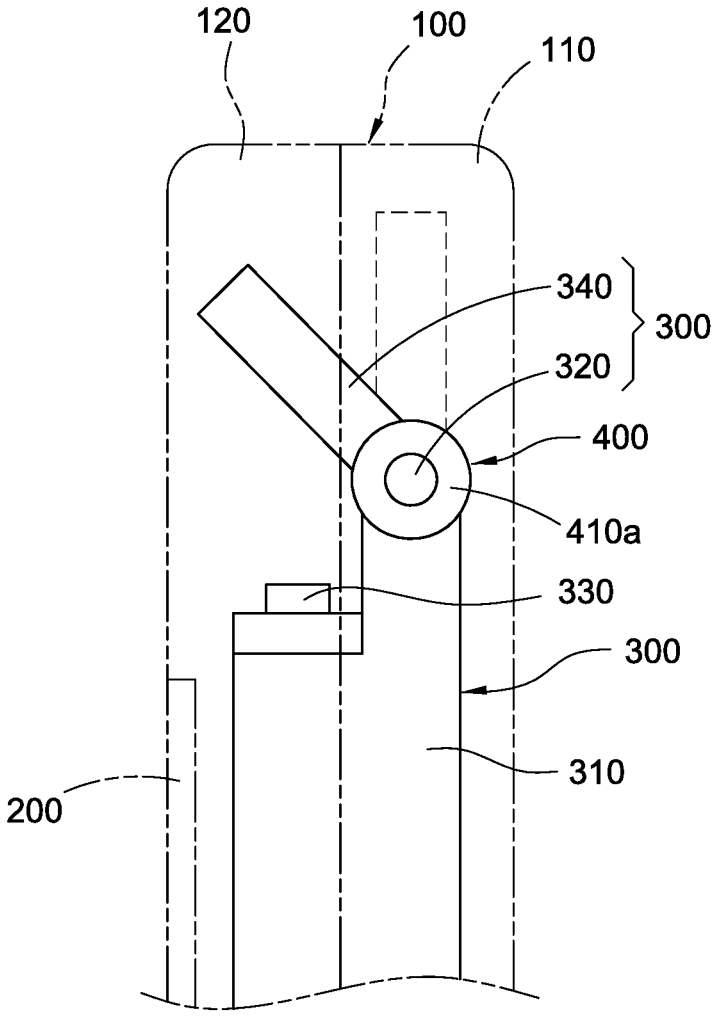
FIG. 10 is a schematic view showing an operation status of the mirroring device of the second embodiment of the present disclosure.

According to FIGS. 9 and 10, a mirroring device having a housing 100, a mirroring assembly 200, an adjustable illuminator 300 and an actuator 400 is provided in the second embodiment of the present disclosure.

The housing 100 has a light transmissive cover 120, the light transmissive cover 120 is preferably ring-shaped, and the light transmissive cover 120 is preferably rectangular ring-shaped according to the present embodiment.

The mirroring assembly 200 is arranged on the housing 100, and a display surface 201 is defined on the mirroring assembly 200. The mirroring assembly 200 is surrounded by the light transmissive cover 120 and the display surface 201 is thereby exposed on the housing 100 through the light transmissive cover 120. The aforementioned structures have been described in the first embodiment and is not repeated here for the sake of brevity.

The adjustable illuminator 300 is accommodated in the housing 100 corresponding to position of the light transmissive cover 120. The adjustable illuminator 300 has a bracket 310, and the mirroring assembly 200 is surrounded by the bracket 310. The bracket 310 is preferably circular ring-shaped according to the present embodiment, and the light transmissive cover 120 is preferably rectangular ring-shaped. At least one pivot shaft 320 is arranged on a peripheral of each of a pair of couple edges of the bracket 310, at least one illumination component 330 and at least one pivotal plate 340 corresponding to the illumination component 330 are arranged on the bracket 310, according to the present embodiment, multiple illumination components 330 and a pivotal plate 340 corresponding to the illumination components 330 are preferably arranged on aforementioned each couple edge of the bracket 310. At least one pivot shaft 320 is extended from each pivotal plate 340, and a side edge of each pivotal plate 340 is pivotally connected to the corresponding bracket 310 or housing 100 by the pivot shaft 320.

The pivotal plate 340 is rotatable for altering a projecting direction of the illumination component 330. According to the present embodiment, the projecting directions of the illumination components 330 are disposed divergently along the display surface 201. Each pivotal plate 340 could be pivoted to be oblique related to the display surface 201 and an angle is formed therebetween, and lights projected from the respective illumination components 330 thereby focus on an area with a specific distance in front of the display surface 201. A distance between the display surface 201 and a focus position of the reflected light projected from the illumination component 330 is altered according to change of the angle caused by pivoting of the pivotal plate 340.

According to the present embodiment, the actuator 400 could include only the pusher 410*a*, and the user directly operates the pusher 410*a* to rotate the pivotal plate 340. Specifically, the actuator 400 includes a pusher 410*a* extended from each pivotal plate 340 along the corresponding pivot shaft 320 and penetrating out the housing 100. The pivot shaft 320 is rotated by the pusher 410*a* when the user twists the pusher 410*a*, and the pivotal plate 340 is thereby further pivoted.

Figure 11:
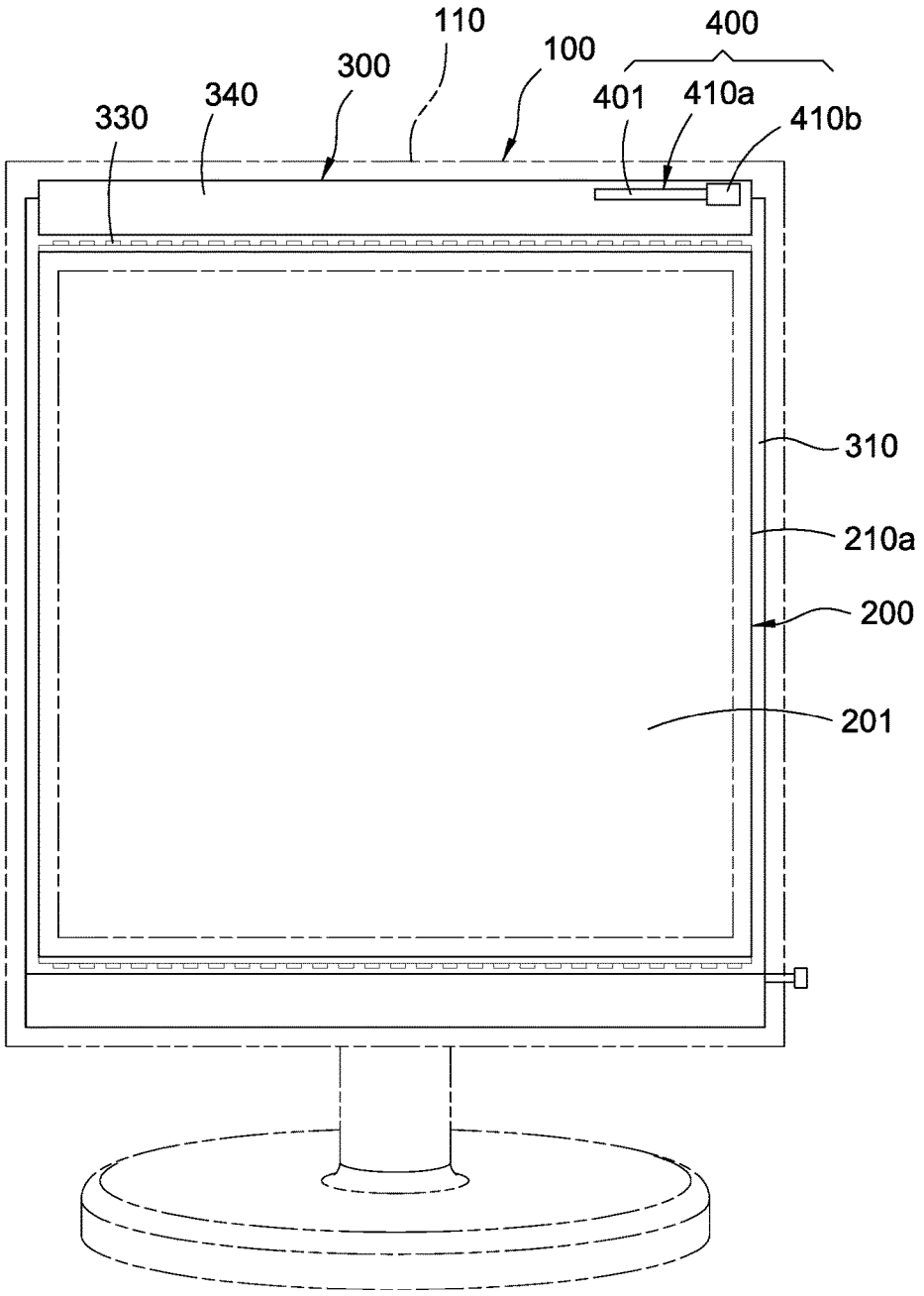
FIGS. 11 and 12 are schematic views showing the mirroring device of the third embodiment of the present disclosure.
Figure 12:
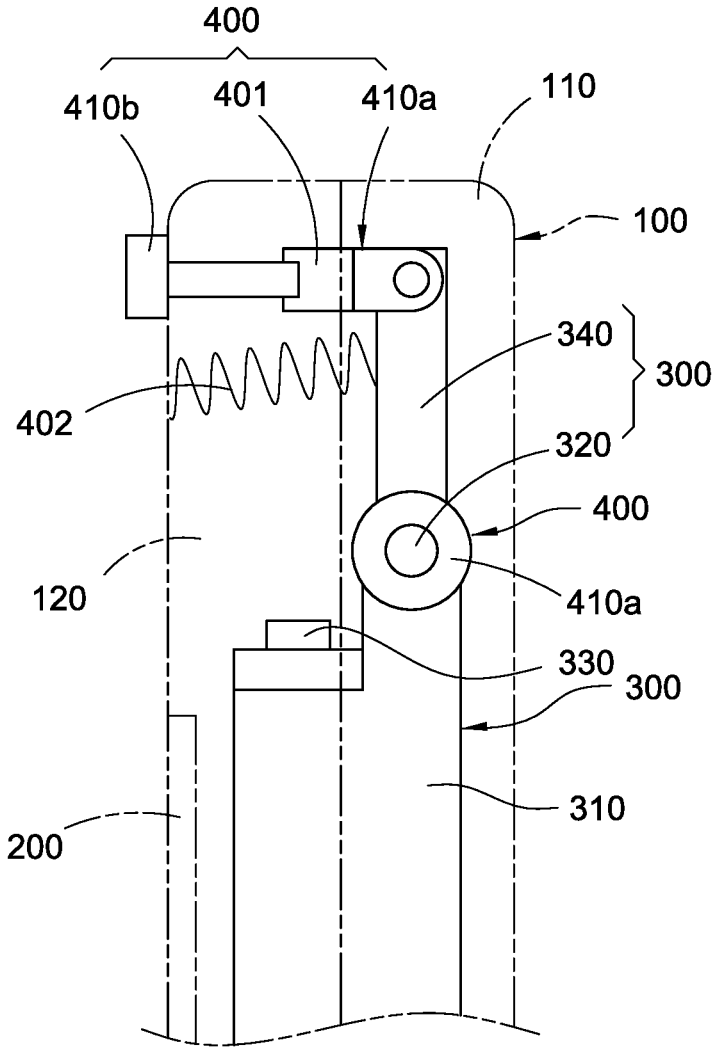

According to FIGS. 11 and 12, a mirroring device having a housing 100, a mirroring assembly 200, an adjustable illuminator 300 and an actuator 400 is provided in the third embodiment of the present disclosure. The housing 100, the mirroring assembly 200 and the adjustable illuminator 300 have been described in the second embodiment and is not repeated here for the sake of brevity.

According to the present embodiment, the slope 401 is formed on the pusher 410*a*, the pusher 410*a* could be pivotally or fix connected with the pivotal plate 340, and the slope 401 is substantially extended along a longitudinal direction of the pivotal plate 340 and disposed slightly oblique related to the pivot shaft 320. The operating member 410*b* is arranged on the housing 100 and movable, and the operating member 410*b* presses on the slope 401. Specifically, the operating member 410*b* is a sliding block, the operating member 410*b* protrudes on the housing 100 and is linearly slidable along the slope 401. The user moves the operating member 410*b* along the slope 401 and the pusher 410*a* is thereby moved to further pivot the pivotal plate 340. The pivotal plate 340 is connected to an elastic member 402 for pivoting the pivotal plate 340 to push the pusher 410*a* toward and press on the operating member 410*b*. According to the present embodiment, the elastic member 402 is preferably a spring and two ends thereof are respectively connected with the housing 100 and the pivotal plate 340, but scope of the present disclosure should not be limited to the embodiment.

Figure 13:
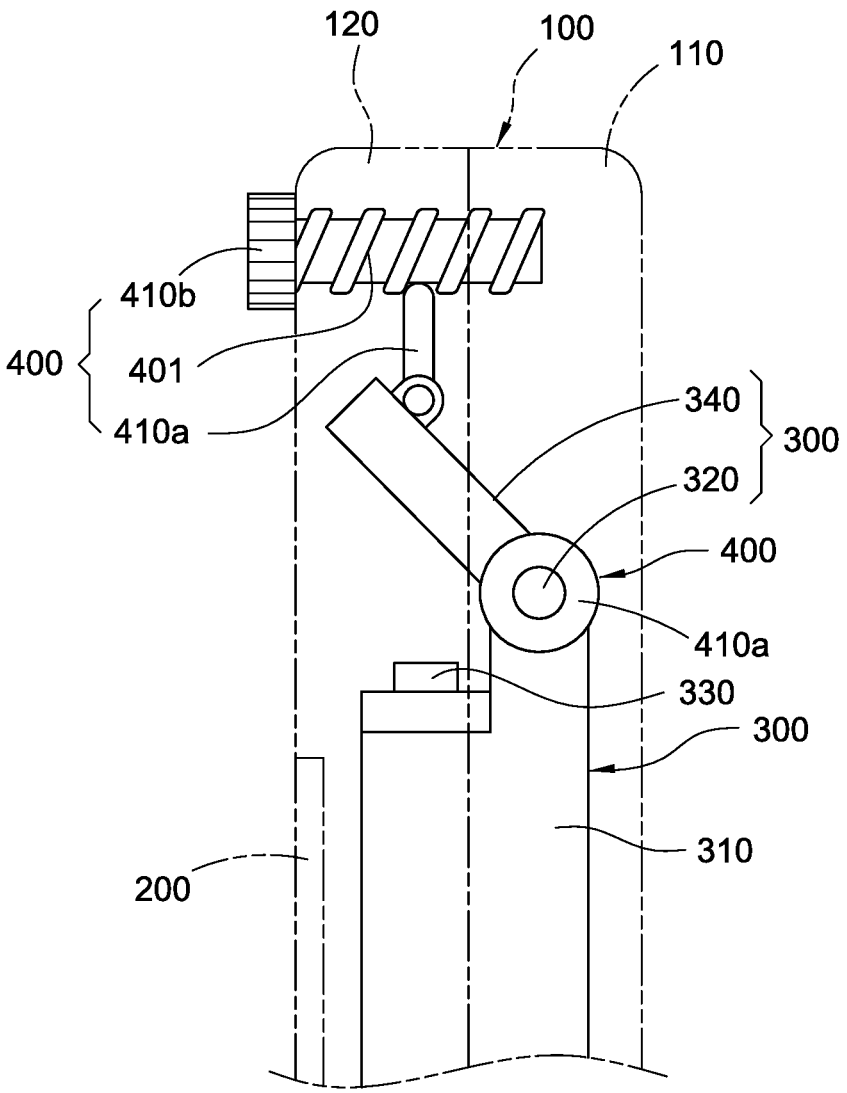
FIG. 13 is a schematic view showing the mirroring device of the fourth embodiment of the present disclosure.

According to FIG. 13, a mirroring device having a housing 100, a mirroring assembly 200, an adjustable illuminator 300 and an actuator 400 is provided in the fourth embodiment of the present disclosure. The housing 100, mirroring assembly 200 and the adjustable illuminator 300 have been described in the second embodiment and is not repeated here for the sake of brevity.

Specifically, according to the present embodiment, the pusher 410*a* is a level, an end of the pusher 410*a* is pivotally connected to one of the pivotal plates 340 and rotatable related to the pivotal plate 340, and the pivotal plate 340 thereby could be pivoted. The operating member 410*b* could be a screw rod or a screw nail, and the slope 401 therefore could formed on teeth of the screw rod or screw nail. The other end of the pusher 410*a* presses on the slope 401. The slope 401 is rotated related to the pusher 410*a* when the operating member 410*b* is twisted by the user, and the pusher 410*a* could be moved by the slope 401 and the pivotal plate 340 is thereby further pivoted. The pusher 410*a* is rotated and pushed by the slope 401 to move forward or backward related to the display surface 201, and the pivotal plate 340 is thereby further pivoted. The operating member 410*b* could be twisted by the user or by a motor (not shown in Figs.) engaged therewith, and the actuator 400 drives the pusher 410*a* by the motor and therefore could be electrically controlled or remote controlled.

Figure 14:
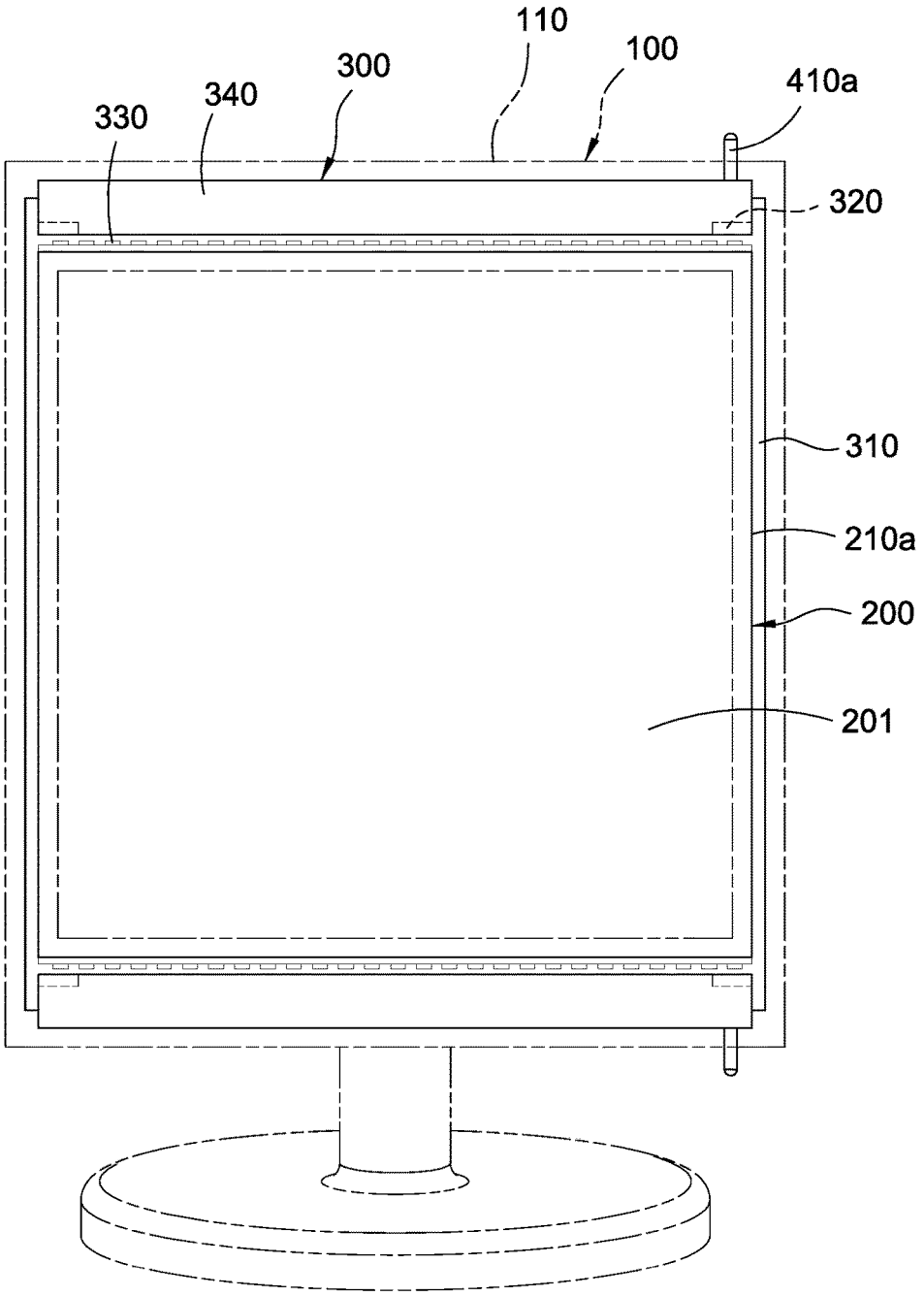
FIG. 14 is a schematic view showing the mirroring device of the fifth embodiment of the present disclosure.

According to FIG. 14, a mirroring device having a housing 100, a mirroring assembly 200, an adjustable illuminator 300 and an actuator 400 is provided in the fifth embodiment of the present disclosure. The housing 100 and the mirroring assembly 200 have been described in the second embodiment and it not repeated here for the sake of brevity.

According to the adjustable illuminator 300 in the present embodiment, what is different from the second embodiment is that at least one pivot shaft 320 is fixed on a peripheral of each of a pair of couple edges of the bracket 310 of the adjustable illuminator 300, and the pivot shafts 320 are arranged parallel with the couple edges. A pivotal plate 340 is arranged corresponding to each couple edge and a side edge of each pivotal plate 340 is pivotally connected to the corresponding pivot shaft 320.

At least one illumination component 330 is arranged on each pivotal plate 340 of the adjustable illuminator 300. According to the present embodiment, multiple illumination components 330 are preferably arranged on each pivotal plate 340. The illumination component 330 are arranged on a surface of the pivotal plate 340 and at a side edge of the pivotal plate 340 where the display surface 201 is located, respective projecting directions of the respective illumination components 330 are perpendicular to the pivotal plate 340, respective projecting directions of the respective illumination components 330 are perpendicular to the pivotal plate 340, each pivotal plate 340 could be pivoted to be oblique related to the display surface 201 and an angle is formed therebetween, and lights projected from the respective illumination components 330 thereby focus on an area with a specific distance in front of the display surface 201. A distance between the display surface 201 and a focus position of the reflected light projected from the illumination component 330 is altered according to change of the angle caused by pivoting of the pivotal plate 340.

The actuator 400 could include only the pusher 410*a*, and the user directly operates the pusher 410*a* to rotate the pivotal plate 340. Specifically, the actuator 400 has pushers 410*a* connected to the respective pivotal plates 340 and penetrating out the housing 100. The respective pushers 410*a* rotate the respective pivotal plates 340 when the user rotates the respective pushers 410*a* along the pivot shaft 320.

The mirroring device of the present disclosure has the adjustable illuminator 300, the adjustable illuminator 300 alters projecting directions of the illumination components 330 by pivoting a pivotal plate 340 and thereby alters focus position of projected lights.

Although the present disclosure has been described with reference to the foregoing preferred embodiment, it will be understood that the disclosure is not limited to the details thereof. Various equivalent variations and modifications can still occur to those skilled in this art in view of the teachings of the present disclosure. Thus, all such variations and equivalent modifications are also embraced within the scope of the present disclosure as defined in the appended claims.

What is claimed is:

1. A mirroring device, comprising:

a housing comprising a light transmissive cover;

a mirroring assembly arranged on the housing and comprising a display surface, the display surface being exposed on the housing, and the mirroring assembly being surrounded by the light transmissive cover;

an adjustable illuminator accommodated in the housing corresponding to the light transmissive cover, the adjustable illuminator comprising a bracket, the mirroring assembly is surrounded by the bracket, at least one illumination component and at least one pivotal plate corresponding to the illumination component being arranged on the bracket, the pivotal plate being rotatable for altering a projecting direction of the illumination component; and an actuator comprising a pusher connected with the pivotal plate for pushing the pivotal plate to rotate.

2. The mirroring device according to claim 1, wherein the actuator comprises an operating member, a slope is formed on one of the operating member and the pusher, the other of the operating member and the pusher is pressed by the slope, the pivotal plate is pushed to rotate by the operating member when the operating member is moved according to the pusher.

3. The mirroring device according to claim 2, wherein the slope is formed on the operating member, the pusher is pivotally connected to the pivotal plate and the slope is pressed by the pusher.

4. The mirroring device according to claim 3, wherein the light transmissive cover is circular ring-shaped and thereby being able to rotate around the bracket and be the operating member, the slope is arranged on an internal surface of the light transmissive cover, the slope is rotated by the light transmissive cover to push the pusher when the light transmissive cover is rotated and the pivotal plate is further rotated.

5. The mirroring device according to claim 3, wherein the operating member is a screw rod arranged in the housing and is rotatable, the slope is formed on teeth of the screw rod, the slope is rotated by the screw rod to push the pusher when the screw rod is rotated, and the pivotal plate is further rotated.

6. The mirroring device according to claim 2, wherein the slope is formed on the pusher, the operating member is arranged in the housing and movable, and the slope is pressed by the operating member.

7. The mirroring device according to claim 2, wherein the pivotal plate is connected with an elastic member for pushing the pivotal plate to rotate and the pusher is thereby pushed toward the operating member.

8. The mirroring device according to claim 2, wherein the slope is disposed oblique related to the display surface.

9. The mirroring device according to claim 1, wherein the adjustable illuminator comprises a plurality of pivotal plates, the pivotal plates are arranged surrounding the mirroring assembly, and each pivotal plate is hooked with another adjacent pivotal plate, the respective pivotal plates hooked with each other are rotatable and interlocked with each other.

10. The mirroring device according to claim 9, wherein a couple of flanges are respectively protruded from opposite edges of each pivotal plate, and each of the flanges is hooked with adjacent flange on the adjacent pivotal plate.

11. The mirroring device according to claim 10, wherein the respective flanges of each pivotal plate are arranged deviated from each other and respectively toward two surfaces of the pivotal plate, and each flange is stacked and hooked with another flange on another adjacent pivotal plate.

12. The mirroring device according to claim 1, wherein the actuator comprises the pusher connected with the pivotal plate and penetrating the housing.

13. The mirroring device according to claim 1, wherein a pivot shaft is extended from the pivotal plate and the pivot shaft is pivotally connected to the bracket, and the pusher is extended along the pivot shaft from the pivotal plate and penetrates the housing.

14. The mirroring device according to claim 1, wherein the pivotal plate is pivotally connected with the housing by a pivot shaft, and the pusher is extended along the pivot shaft from the pivotal plate and penetrates the housing.

15. The mirroring device according to claim 1, wherein the mirroring assembly comprises a reflector, the reflector is surrounded by the light transmissive cover, the display surface for reflecting and displaying a mirror image is formed on the reflector.

16. The mirroring device according to claim 1, wherein the mirroring assembly comprises a lens and a display panel, the display panel is electrically connected to the lens, the display panel is surrounded by the light transmissive cover, the display surface is formed on the display panel for displaying an imaged caught by the lens, and the lens and the display surface are arranged toward the same direction.

* * * * *